US011619031B2

(12) United States Patent
Parzynski, Jr. et al.

(10) Patent No.: US 11,619,031 B2
(45) Date of Patent: Apr. 4, 2023

(54) RETENTION SYSTEM FOR MOTOR GRADER BITS

(71) Applicant: Caterpillar Inc., Deerfield, IL (US)

(72) Inventors: David Bruno Parzynski, Jr., Peoria, IL (US); Thomas Marshall Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 364 days.

(21) Appl. No.: 17/070,698

(22) Filed: Oct. 14, 2020

(65) Prior Publication Data

US 2021/0025146 A1 Jan. 28, 2021

Related U.S. Application Data

(63) Continuation of application No. 16/180,958, filed on Nov. 5, 2018, now Pat. No. 10,851,523.

(51) Int. Cl.
*E02F 9/28* (2006.01)

(52) U.S. Cl.
CPC ..... *E02F 9/2833* (2013.01); *E02F 9/2808* (2013.01)

(58) Field of Classification Search
CPC ..... E02F 9/2816; E02F 9/2833; E02F 9/2858
See application file for complete search history.

(56) References Cited

U.S. PATENT DOCUMENTS

| | | | |
|---|---|---|---|
| 594,896 | A | 12/1897 | Palmer |
| 2,612,361 | A | 9/1952 | Loy |
| 4,076,318 | A | 2/1978 | Hauschopp et al. |
| 4,299,424 | A | 11/1981 | LeBegue et al. |
| 4,335,921 | A | 6/1982 | Swisher, Jr. et al. |
| 4,753,299 | A | 6/1988 | Meyers |
| 4,883,129 | A | 11/1989 | Lonn et al. |
| D308,684 | S | 6/1990 | Meyers |
| 5,007,685 | A | 4/1991 | Beach et al. |
| 5,094,398 | A | 3/1992 | Jeter et al. |
| 5,720,528 | A | 2/1998 | Ritchey |
| 5,992,045 | A | 11/1999 | Sollami |
| 6,024,143 | A | 2/2000 | Ritchey |
| 6,202,327 | B1 | 3/2001 | Fuller et al. |
| 6,203,049 | B1 | 3/2001 | Gibson |
| 7,299,836 | B2 | 11/2007 | Green |

(Continued)

FOREIGN PATENT DOCUMENTS

| | | | |
|---|---|---|---|
| CN | 108487367 | A | 9/2018 |
| DE | 102005055544 | A1 | 5/2007 |
| WO | 2017023804 | A1 | 2/2017 |

*Primary Examiner* — Gary S Hartmann

(74) *Attorney, Agent, or Firm* — von Briesen & Roper, s.c.

(57) ABSTRACT

A tool bit includes a threaded portion, a shank, a shoulder, an anti-rotation segment and a working portion. The threaded portion may be centered about and extend longitudinally along a first axis. The shank may be centered about the first axis and extend longitudinally along the first axis. The shank may be disposed between the threaded portion and the shoulder. The anti-rotation segment may be disposed between the shoulder and the working portion of the tool bit. The working portion may be oriented to extend lengthwise away from the first axis and to extend lengthwise along another axis that is transverse to the first axis. The working portion may include a planar cutting surface that includes a working edge. The planar cutting surface may be oriented transverse to the first axis.

20 Claims, 6 Drawing Sheets

(56) References Cited

U.S. PATENT DOCUMENTS

| | | | | |
|---|---|---|---|---|
| 7,997,056 | B2 | 8/2011 | Segura | |
| 8,061,386 | B2 | 11/2011 | Mueller et al. | |
| 8,528,990 | B2 | 9/2013 | Latham | |
| 8,534,766 | B2 | 9/2013 | Ritchey et al. | |
| 9,212,553 | B2 | 12/2015 | Sollami | |
| 9,551,217 | B2 | 1/2017 | Ries et al. | |
| 9,687,997 | B2 | 6/2017 | Micacchi | |
| 10,046,479 | B2 | 8/2018 | Lehnert et al. | |
| 10,125,471 | B2 | 11/2018 | Congdon | |
| 10,385,690 | B2 | 8/2019 | Roth | |
| 10,590,632 | B2 * | 3/2020 | Parzynski | E02F 9/2816 |
| 10,851,523 | B2 * | 12/2020 | Parzynski, Jr. | E02F 3/76 |
| 10,889,966 | B2 * | 1/2021 | Parzynski, Jr. | E02F 9/2825 |
| 2012/0019044 | A1 | 1/2012 | Monyak et al. | |
| 2012/0167420 | A1 * | 7/2012 | Fader | E21C 35/183 37/91 |
| 2015/0130258 | A1 | 5/2015 | Sollami | |
| 2015/0300166 | A1 | 10/2015 | Ries et al. | |
| 2016/0024917 | A1 * | 1/2016 | Hall | E21C 35/197 299/113 |
| 2016/0229084 | A1 | 8/2016 | Lehnert et al. | |
| 2018/0171586 | A1 | 6/2018 | Congdon et al. | |
| 2018/0195255 | A1 | 7/2018 | Parzynski et al. | |
| 2018/0266578 | A1 | 9/2018 | Baxter | |

* cited by examiner

RETENTION SYSTEM FOR MOTOR GRADER BITS

CROSS-REFERENCE TO RELATED APPLICATION

This application is a continuation of, and claims priority under 35 U.S.C. § 120 to, previously-filed application U.S. Ser. No. 16/180,958, filed Nov. 5, 2018.

TECHNICAL FIELD

The present disclosure generally systems and methods of retaining bits, and more particularly, to a system for securing motor grader bits in an adapter board of a motor grader machine.

BACKGROUND

Work machines, such as motor graders, may have ground engagement members (e.g., wheels or tracks) to drive the machine over the ground. A motor grader may be equipped with a tool, such as a blade, to bear against the ground over which it is driven. In some applications, the grader is equipped with a series of bits instead of a blade to better cut and break up the ground. In such a configuration, the blade is replaced with an adapter board, or mold board, that secures the bits.

Retention of the bits into the moldboard may be performed with applying nuts or snap rings on a back side of the bits. Under operating conditions, vibration of the machine may cause for loosening of the bit retention mechanisms. Further, snap rings may be difficult to install and may become lost during operation. The snap rings may become lost due to material buildup, improper installation, and the like. Without the snap ring for retention, the cutting bit may fall out of the moldboard and be lost.

U.S. Pat. No. 4,883,129A entitled Bit Assembly Utilizing Carbide Insert, provides for a ground engaging bit used in abrasive road grading applications. Due to wear, carbide inserts in the tips often break requiring replacement. The '129 patent provides for a means for retaining the bit assembly that includes a retaining ring located in a groove of a shank on the bit.

While arguably effective for its intended purpose there is still need for improved retention of motor grader tool bits.

SUMMARY

In accordance with one aspect of the present disclosure, a tool bit is disclosed. The tool bit may comprise a threaded portion, a shank, a shoulder, an anti-rotation segment and a working portion. The threaded portion may be centered about and extend longitudinally along a first axis. The threaded portion may include an anti-rotation receiving hole therethrough. The anti-rotation receiving hole may be oriented to extend along a second axis that is transverse to the first axis. The shank may be centered about the first axis and extend longitudinally along the first axis. The shank may be disposed between the threaded portion and the shoulder. The shoulder may extend radially outward from the shank. The anti-rotation segment may be disposed between the shoulder and the working portion of the tool bit. The anti-rotation segment may include a first surface and a second surface that is disposed opposite to the first surface. In an embodiment, the anti-rotation segment is configured to be received in an anti-rotation slot of an adapter board when the tool bit is mounted on the adapter board. The working portion may be oriented to extend lengthwise away from the first axis and to extend lengthwise along a third axis that is transverse to the first axis. The working portion may include a planar cutting surface that includes a working edge. The planar cutting surface may be oriented transverse to the first axis.

In another aspect of the present disclosure, a tool bit is disclosed. The tool bit may comprise an internally threaded portion, a shank, a shoulder, an anti-rotation segment and a working portion. The internally threaded portion may be centered about and extend longitudinally along a first axis. The internally threaded portion may be configured to receive a retention bolt oriented parallel to the first axis. The shank may be centered about and extend longitudinally along the first axis, wherein at least part of the shank may be disposed between the threaded portion and the shoulder. The shoulder may extend radially outward from the shank. The anti-rotation segment may be disposed between the shoulder and the working portion of the tool bit. The anti-rotation segment may include a first surface and a second surface disposed opposite to the first surface. The anti-rotation segment may be configured to be received in an anti-rotation slot of an adapter board when the tool bit is mounted on the adapter board. The working portion may be oriented to extend lengthwise away from the first axis and to extend lengthwise along a second axis that is transverse to the first axis. The working portion may include a planar cutting surface that includes a working edge. The planar cutting surface may be oriented transverse to the first axis.

In yet another aspect of the present disclosure, a system for securing a plurality of tool bits to a machine that includes a mold board is disclosed. The system comprises an adapter board and a plurality of tool bits. The adapter board may include a plurality of bores extending therethrough, a front surface, a plurality of anti-rotation slots and a back surface. The back surface is configured to define a clearance region with a bottom edge of the mold board when the back surface is mounted to the mold board. The clearance region is adjacent to the plurality of bores. The plurality of tool bits is disposed in the plurality of bores in a one-to-one correspondence. Each tool bit may include a threaded portion, a shank, a shoulder, an anti-rotation segment, a working portion and a castle nut. The threaded portion may be centered about a first axis and extend longitudinally along the first axis. The threaded portion may include an anti-rotation receiving hole therethrough that is oriented to extend along a second axis that is transverse to the first axis. The shank may be centered about and extend longitudinally along the first axis. The shank may be disposed between the threaded portion and the shoulder. The shoulder may extend radially outward from the shank. The anti-rotation segment may be disposed between the shoulder and the working portion. The anti-rotation segment may include a first surface and a second surface disposed opposite to the first surface. The first surface and the second surface are disposed in one of the plurality of anti-rotation slots of the adapter board. The working portion may be oriented to extend lengthwise away from the first axis and to extend lengthwise along a third axis. The third axis may be transverse to the first axis. The working portion may include a planar cutting surface that includes a working edge. The planar cutting surface may be oriented transverse to the first axis. In an embodiment, the working edge may be oriented parallel to the second axis. The castle nut is configured to be in threaded engagement with the threaded portion of the tool bit. The castle nut includes a plurality of slots. A first slot may be configured to receive a first portion of a pin when a second portion of the pin is disposed within the anti-rotation receiving hole.

These and other aspects and features of the present disclosure will be more readily understood when read in conjunction with the accompanying drawings.

DETAILED DESCRIPTION

Figure 1:
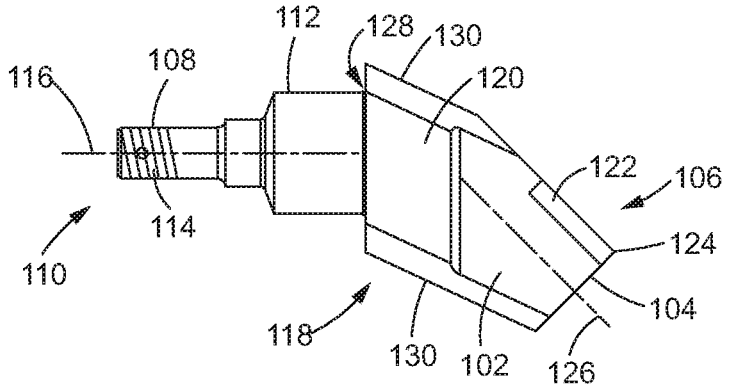
FIG. 1 is a side-view of a first tool bit, in accordance an embodiment of the present disclosure.

Referring now to the drawings, and with specific reference to FIG. 1, a tool bit 102 is disclosed. In particular, FIG. 1 depicts the side view 100 of the tool bit 102. A working portion 104 is located at a distal end 106 of the tool bit 102. A threaded portion 108 is located at a proximal end 110 of the tool bit 102. A shank 112, and the threaded portion 108, extend along a longitudinal axis 116. The working portion 104 extends along the working-portion axis 126. In some embodiments, the working portion 104 does not extend along the same axis as the longitudinal axis 116, such as depicted in the view 100 of the tool bit 102. Here, the working portion 104 is angled down and to the right along the working-portion axis 126 as compared to the longitudinal axis 116. As such, the longitudinal axis 116 and the working-portion axis 126 intersect. The difference in angle between the longitudinal axis 116 and the working-portion axis 126 provide for proper engagement of the working portion 104 with a ground surface (not depicted). At the working portion 104, a cutting surface 122 may be have a planar shape and be realized by a carbide tip, a tungsten carbide tip, or the like. While the cutting surface 122 may be designed to be durable, it may be desirable for a tool bit securing system to provide for replacement of individual tool bits on a machine due to wear experienced during operations.

At the proximal end 110, the tool bit 102 includes a threaded portion 108. The threaded portion 108 is configured to receive a fastener. In some embodiments, such as those depicted in FIG. 1, the threaded portion 108 includes threads on an outer surface of the threaded portion (e.g., is externally threaded). In such embodiments, the fastener may be realized by a nut, a castle nut, or the like. In other embodiments, discussed in conjunction with FIGS. 8 and 9, the threaded portion 108 may be realized by an internally threaded portion 808 and the fastener may be realized by a retention bolt 804. Returning to the discussion of FIG. 1, the threaded portion 108 includes an anti-rotation receiving hole 114. In some embodiments, the anti-rotation receiving hole 114 is drilled into the threaded portion 108 and is transverse to the longitudinal axis 116. The location of the anti-rotation receiving hole 114 may be placed at a location along the longitudinal axis 116 to permit engagement with a pin 302 that is disposed between slots 206 of a nut 202.

At the end of the shank 112 away from the proximal end 110, the tool bit 102 transitions to a shoulder 128 that includes a larger cross-sectional area than that of the shank 112. The shoulder 128 is configured to abut against an adapter plate in response to a force applied along the longitudinal axis 116 (e.g., by a nut 202 engaging with the threaded portion 108 or by the working portion 104 being engaged with the ground surface).

In some embodiments, the tool bit 102 includes an anti-rotation segment 118. As depicted in the view 100, the anti-rotation segment 118 may be realized by a flat side 120. Here, the tops and the bottoms of the tool bit may be realized as having rounded surfaces 130. However, the flat side 120 is configured to abut against an anti-rotation slot 602 on a leading edge 514 of an adapter board 506. The flat-surface to flat-surface engagement between the flat side 120 and the anti-rotation slot 602 prevent the tool bit 102 from rotating about its longitudinal axis 116.

In some embodiments, the anti-rotation segment 118 includes two parallel flat surfaces on opposing sides of the tool bit. Each of the flat surfaces may engage with the anti-rotation slot 602 to prevent rotation of the tool bit 102 when secured into the adapter board 506. In other embodiments, the anti-rotation segment 118 may include keying to ensure that the tool bit 102 is installed in the correct orientation when secured to the adapter board 506. For example, the tool bit 102 may have an anti-rotation segment 118 having a flat surface 120 on a first side of the tool bit 102 and a rounded portion 130 on the opposite side of the tool bit 102. The anti-rotation slot 602 may be complementarily designed to allow full insertion of the tool bit 102 into the adapter board 506 only when the tool bit 102 is properly oriented.

Figure 2:
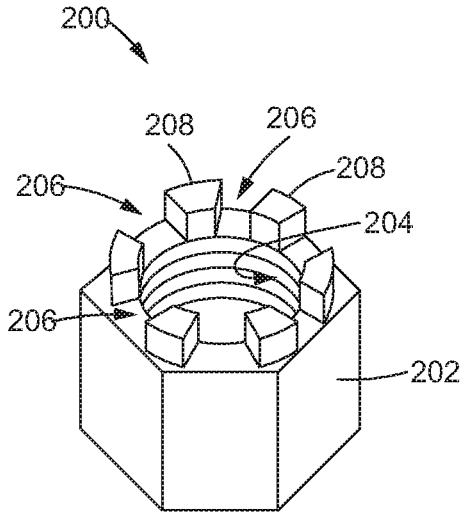
FIG. 2 is a perspective view of a nut, in accordance with an embodiment of the present disclosure.

FIG. 2 is a perspective view of a nut, in accordance with an embodiment of the present disclosure. In particular, FIG. 2 depicts the perspective view 200 of the nut 202. In some embodiments, the nut 202 is a castle nut having the features depicted in the view 200. The nut 202 includes threads 204 located about an inner circumference of the nut 202. The threads 204 are configured to engage with the threaded portion 108 of the tool bit 102. In such an embodiment, the nut 202 may have the same diameter opening as the threaded portion 108 and be machined with threads of a pitch that complement the threads of the threaded portion 108. The nut 202 further includes a plurality of slots 206 disposed between a plurality of upright members 208. The upright members 208 are positioned such that the slots 206 are configured to receive a pin 302 being inserted through the anti-rotation receiving hole 114.

Figure 3:
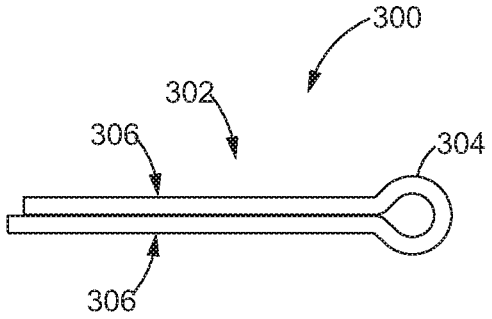
FIG. 3 is a side view of a pin, in accordance with an embodiment of the present disclosure.

FIG. 3 is a side view of a pin, in accordance with an embodiment of the present disclosure. In particular, FIG. 3 is a perspective view 300 of the pin 302. The pin 302 may be adapted to be inserted through the anti-rotation receiving hole 114 and a nut 202. The pin 302 includes an eyelet 304 on the right portion of the view 300 and two tail ends 306 on the left side of the view 300 that are able to be deformed. The dimension across the eyelet 304 (e.g., the eyelet diameter) may be selected to be larger than a diameter of the anti-rotation receiving hole 114 to prevent the pin 302 from being pulled through the anti-rotation receiving hole 114.

In some embodiments, the pin 302 may be realized as a cotter pin. In other such embodiments, the pin 302 may be realized by a piece of lock wire inserted through the anti-rotation receiving hole 114, with ends of the lock wire twisted together to secure the lock wire into the anti-rotation receiving hole 114.

Figure 4:
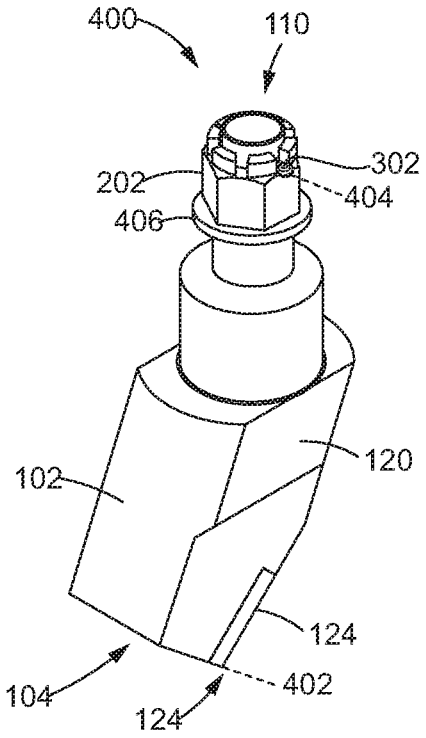
FIG. 4 is a perspective view of the first tool bit engaged with a nut, in accordance with an embodiment of the present disclosure.

FIG. 4 is a perspective view of the first tool bit engaged with a nut, in accordance with an embodiment of the present disclosure. In particular, FIG. 4 depicts the perspective view 400 that includes the tool bit 102 with a washer 406 disposed about the threaded portion 108, a nut 202 engaged with the threaded portion 108, and a pin 302 inserted through both the slots 206 of the nut 202 and the anti-rotation receiving hole 114. As depicted in FIG. 4, the anti-rotation receiving hole 114 extends along the axis 404. The tool bit 102 also includes the cutting surface 122 having a working edge 124. The working edge 124 extends along the axis 402. In some embodiments, the axis 402 of the working edge 124 is parallel to the axis 404 of the anti-rotation receiving hole 114. As such, when installing a pin 302 into the anti-rotation receiving hole 114 (e.g., in a tool bit securing system), the orientation of the anti-rotation receiving hole 114 may permit increased access to the anti-rotation receiving hole 114 in relation to other obstructions (e.g., adapter plate, mold board). In other embodiments, the anti-rotation receiving hole 114 is drilled into the threaded portion 108 of the tool bit 102 such that its axis 404 is not parallel to the axis 402 of the working edge 124. Such alternate orientations may be selected based on expected obstructions adjacent to the clearance region 510.

Figure 5:
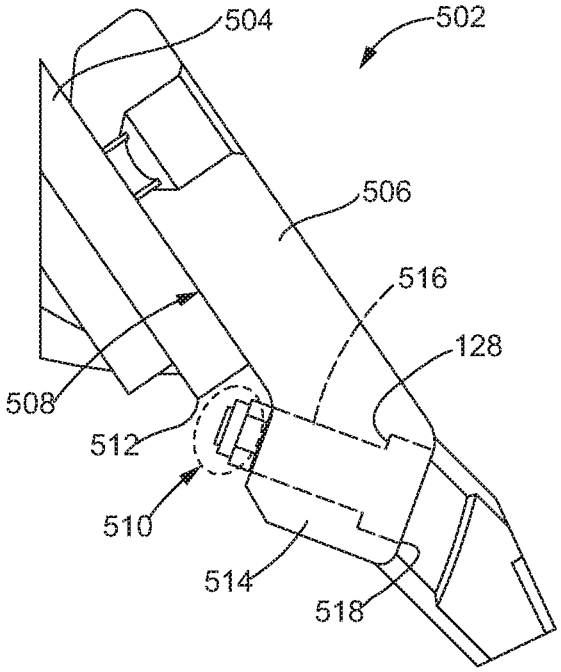
FIG. 5 is side view of a tool bit securing system for the first tool bit, in accordance with an embodiment of the present disclosure.

FIG. 5 is side view of a tool bit securing system for the first tool bit, in accordance with an embodiment of the present disclosure. In particular, FIG. 5 is a side view 500 of the tool bit securing system 502 for the tool bit 102. The securing system 502 includes a mold board 504. In some embodiments, the mold board 504 is a portion of a motor grader machine (not depicted) and serves as an interface between the machine and the tool bits that interact with the ground surface. The mold board 504 attaches to a back surface 508 of an adapter board 506. The adapter board 506 includes a leading edge 514 that includes a bore hole 516. The bore hole 516 is configured and sized to receive the threaded portion 108 of the tool bit 102.

The leading edge 514 may be angled from the remainder of the adapter board 506 in order to provide a proper engagement angle of the working portion 104 of the tool bit 102 with the ground surface. As a result, a clearance region 510 is defined by a bottom edge 512 of the mold board 504 and a back surface 508 of the leading edge 514. The clearance region 510 provides for limited access to the threaded portion 108 of the tool bit. As such, it may be difficult to obtain proper room in the vicinity of the clearance region 510 in order to apply a torque wrench or a socket wrench to a nut in order to secure the tool bit 102 to the adapter board 506. Thus, it may be advantageous, but difficult, to torque an applied nut to the threaded portion 108 in order to minimize backing the off of nuts. The subsequent disengagement between the nuts and the threaded portion, due to vibrations experienced during operation, may cause loss of the tool bit 102.

As seen in FIG. 5, the tool bit 102 is inserted into the bore hole 516, which extends through the leading edge 514 from the clearance region 510 to the front surface 518 of the adapter board 506. The threaded portion 108 of the tool bit 102 extends into the clearance region 510, and the shank 112 is disposed within the bore hole 516. The shoulder 128 abuts against a surface of the adapter board 506, thus limiting the protrusion of the threaded portion 108 into the clearance region 510.

When the tool bit 102 is secured into the adapter board 506, the shank 112 of the tool bit 102 is inserted through the bore hole 516 of the adapter board 506, the threaded portion 108 extends from the bore hole 516 into the clearance region 510, the threads 204 of the nut 202 are engaged with the threaded portion 108 of the tool bit 102, the pin 302 is inserted through two opposing slots 206 of the plurality of slots of the nut 202 and the anti-rotation receiving hole 114.

The tail ends 306 of the pin 302 are deformed around the nut 202 and the eyelet 304 prevents the pin 302 from sliding through the anti-rotation receiving hole 114. The tail ends 306 are configured such that a first tail end 306 may be deformed in a clockwise direction around the nut 202 and the second tail end 306 may be deformed in a counter-clockwise direction around the nut 202.

The upright members 208 thus prohibit the nut 202 from rotating when the pin 302 is installed into the anti-rotation receiving hole 114 through the slots 206. It is envisioned that items other than a pin 302 may be inserted through the anti-rotation receiving hole 114 in order to prevent rotation of the nut 202. For example, lock wire may be inserted through the anti-rotation receiving hole 114 and twisted together to prevent the nut 202 from rotating.

Figure 6:
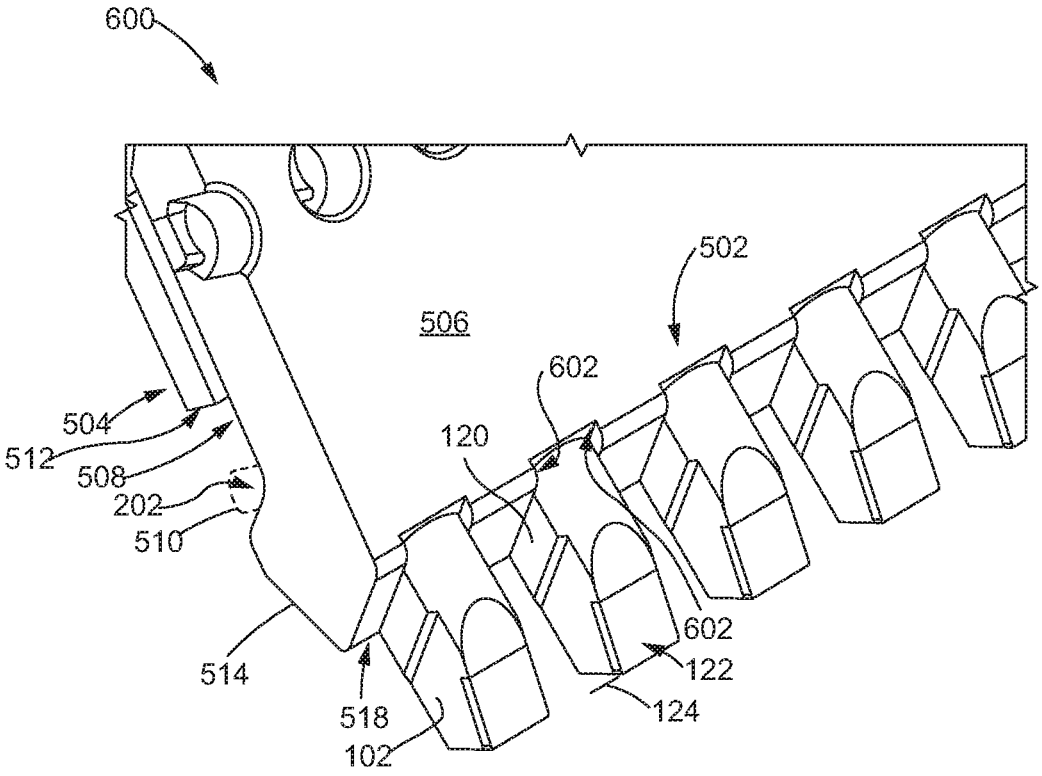
FIG. 6 is a perspective view of the front of a tool bit securing system, in accordance with an embodiment of the present disclosure.

FIG. 6 is a perspective view of the front of a tool bit securing system, in accordance with an embodiment of the present disclosure. In particular, FIG. 6 depicts the view 600 of the tool bit securing system 502. Here, a plurality of tool bits 102 are secured into the adapter board 506. In some embodiments, each of the tool bits 102 may be secured by the aspects disclosed related to the tool bit securing system 502. However, it is envisioned that in some embodiments only one tool bit 102 is secured via the system 502, while other types of tool bits, and their associated tool-bit securing systems, may be used to secure the other tool bits to the adapter board 506.

The adapter board 506 includes the anti-rotation slot 602. Here, the anti-rotation slot 602 is realized by flat surfaces on either side of the tool bit that interact with the anti-rotation segment 118 of the tool bit 102. For example, the tool bit 102 may include the flat side 120 that abuts against the anti-rotation slot 602 when secured into the adapter board 506. The engagement of the two flat surfaces prevents rotation of the tool bit 102 about its longitudinal axis 116.

In some embodiments, the tool bit 102 is secured via a nut 202 being hand-tightened to the threaded portion 108 of the tool bit 102. The hand-tight engagement prevents the tool bit 102 from translating along its longitudinal axis 116. However, the hand-tight engagement may not provide sufficient pressure between the tool bit 102 and the adapter board 506 to prevent rotation about its longitudinal axis 116 without incorporation of the anti-rotation segment 118 and the anti-rotation slots 602 of the adapter board 506.

Figure 7:
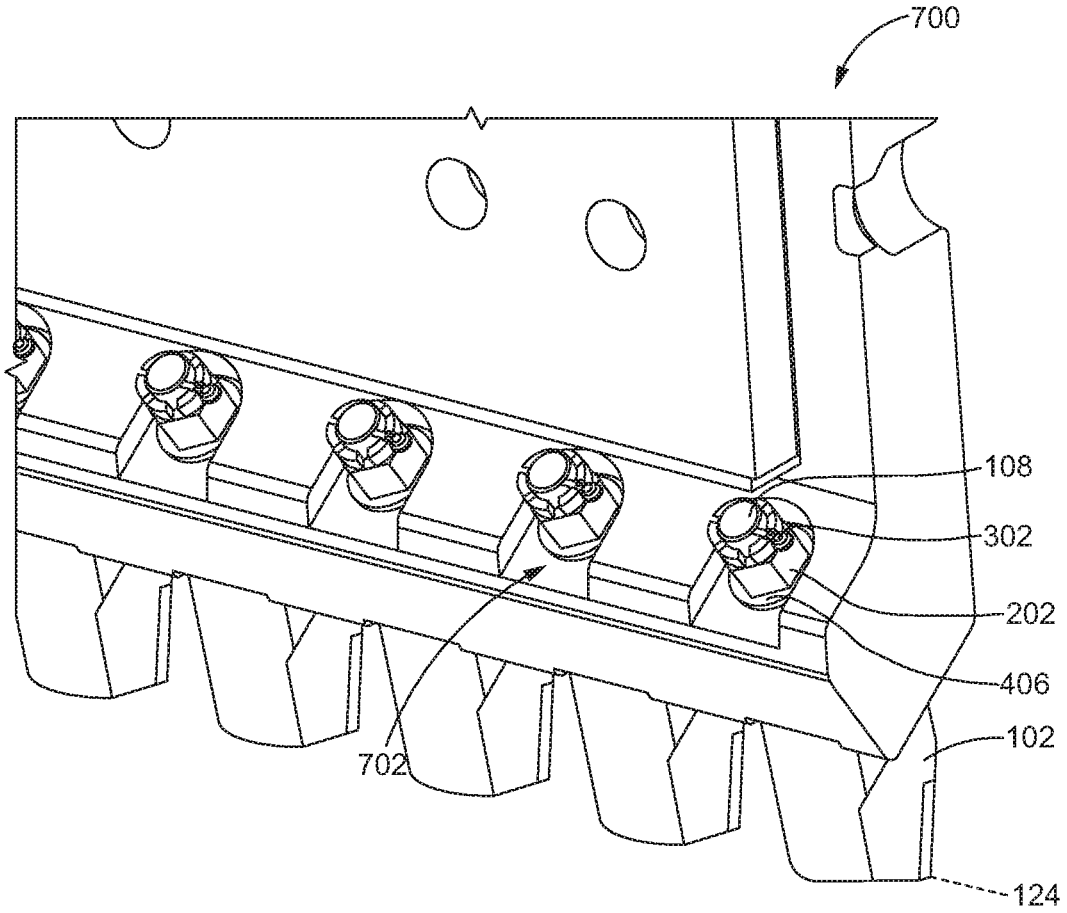
FIG. 7 is a perspective view of the back of the tool bit securing system, in accordance with an embodiment of the present disclosure.

FIG. 7 is a perspective view of the back of the tool bit securing system, in accordance with an embodiment of the present disclosure. In particular, FIG. 7 depicts the perspective view 700 of the back of the tool bit securing system 502 depicted in the view 600 of FIG. 6. Here, a nut 202 is engaged with the threaded portion 108 of the tool bit 102 that extends into the clearance region 510. A pin 302 is inserted through the anti-rotation receiving hole 114, and each of the pins 302 and their respective anti-rotation receiving holes 114 are oriented along an axis that is parallel to the axis of the working edge 124. As such, this orientation permits increased access by an installer to the tail ends 306 of the pins 302 when they are deformed about the nut 202.

In some embodiments, the securing system 502 further includes a washer 406 disposed about the threaded portion 108 of the tool bit 102 and between the nut 202 and the adapter board 506. The washer 406 may provide for a more uniform distribution of forces between the nut 202 and the adapter board 506.

In some other embodiments, the adapter board 506 may include cutouts 702 around the bore hole 516. The cutouts 702 provide for a larger clearance region 510 to permit increased access to the threaded portion 108 of the tool bit 102.

Figure 8:
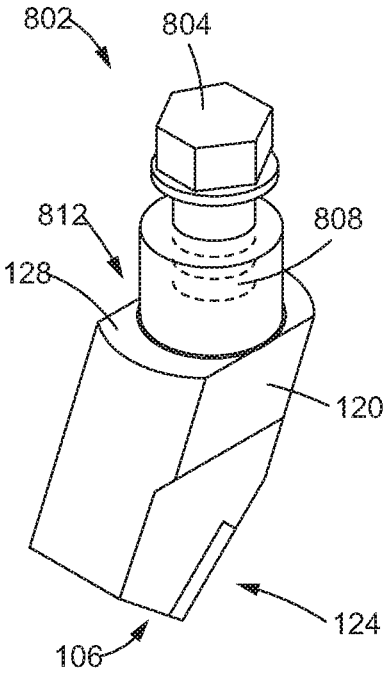
FIG. 8 is a perspective view of a tool bit, in accordance with an embodiment of the present disclosure.

FIG. 8 is a perspective view of a second tool bit, in accordance with an embodiment of the present disclosure. In particular, FIG. 8 depicts the view 800 of the tool bit 802. The tool bit 802 is similar to the tool bit 102. However, the threaded portion 108 includes threads on an inner surface (e.g., the internally threaded portion 808) that are configured to receive a retention bolt 804. The retention bolt 804 may be a threaded bolt, with its threads configured to engage with the internally threaded portion 808 of the tool bit 802. The distal end 106 of the tool bit 802 may be similarly designed as the distal end 106 of the tool bit 102, and thus include the cutting surface 122, the anti-rotation segment 118, the shoulder 128, and the like.

In such an embodiment, the shank 812 of the tool bit 802 is configured not to extend into the clearance region 510. To secure the tool bit 802 into the adapter board 506, the shank 812 of the tool bit 802 may be inserted into the bore hole 516, a washer 406 may be disposed about the retention bolt 804, and the retention bolt 804 may be inserted into (e.g., threaded into) the internally threaded portion 808 of the tool bit 802 via access from the clearance region 510.

Due to the retention bolt 804 having a lower profile (e.g., it does not extend as far into the clearance region 510), the retention bolt 804 may be torqued with a tool (e.g., by a wrench or a socket) in order to provide sufficient tightness to prevent the retention bolt 804 from backing from vibrations experienced during normal operations. Such a system 802 provides for a reduction of parts as compared to tool bit securing system 502. This is because the system 802 does not require use of a pin 302 and replaces the nut 202 with the retention bolt 804. Further, the additional manufacturing step of drilling of an anti-rotation receiving hole 114 is also not required.

Figure 9:
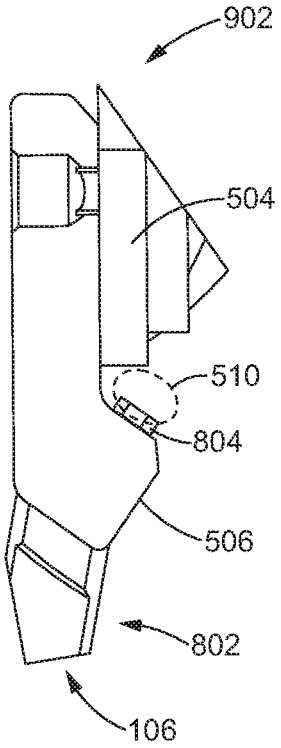
FIG. 9 is a side view of a tool securing system, securing the tool bit depicted in FIG. 8, in accordance with an embodiment of the present invention.

FIG. 9 is a side view of a tool securing system, securing the tool bit depicted in FIG. 8, in accordance with an embodiment of the present invention. In particular, FIG. 9 depicts the side view 900. The side view 900 is similar to the side view 500, but instead depicts the tool bit 802 being secured to the adapter board 506 with a retention bolt 804.

As depicted in the view 900, the head of the retention bolt 804 extends into the clearance region 510. The working portion 104 is similar to that of the working portion 104 of the tool bit 102.

INDUSTRIAL APPLICABILITY

In general, the teachings of the present disclosure may find applicability in many motor grader application. For instance, the teachings of the present disclosure may be applicable to any motor grader machines of differing sizes and orientations and for working on different road and ground surfaces.

Figure 10:
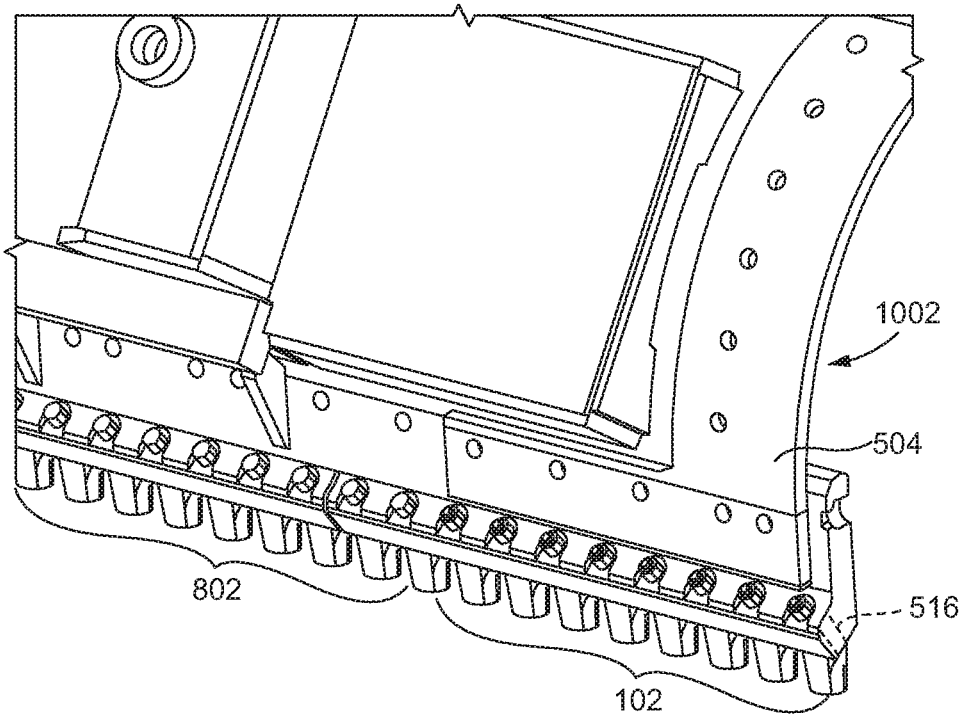
FIG. 10 is a perspective view of the rear of a motor grader having a plurality of tool bits secured to an adapter board, in accordance with an embodiment of the present disclosure.

FIG. 10 is a perspective view of the rear of a motor grader 1002 having a plurality of tool bits secured to an adapter board 506, in accordance with an embodiment of the present disclosure. In particular, FIG. 10 depicts the perspective view 1000 of the rear of the motor grader 1002 that implements the tool bit securing systems 502 and 902 to secure the respective tool bits 102 and 802.

Here, a portion of the mold board 504 on the right portion of the motor grader 1002 provides for a narrower clearance region 510 than does the center portion of the motor grader blade 1002. As such, the tool bits 102 are installed into the eight right-most bore holes 516 via the tool bit securing system 502. This includes a tool bit 102 having a threaded portion 108 configured being inserted through a respective bore hole 516 into the clearance region 510. A nut 202 is threaded onto the threaded portion 108 of the tool bit 102, and a pin 302 is inserted through the anti-rotation receiving hole 114 to restrain the nut 202 from rotating.

In the middle portion of the motor grader 1002, a larger clearance region 510 may exist as the attachment portion of the mold board 504 may not provide for such a limited size of the clearance region 510. As such, the tool bits 802 may be secured into the adapter board 506 via a retention bolt 804 engaging with the internally threaded portion 808 of the tool bit 802. These retention bolts 804 may be secured by torqueing the retention bolts 804 with a torque wrench in order to sufficiently secure the tool bit 802 to the adapter board 506.

It is further envisioned that each bore hole 516 in the adapter board 506 may be configured to receive either of the tool bit 102 or the tool bit 802, thus permitting installation of any available tool bit (102 or 802) into the respective bore hole 516. While the view 1000 depicts a mixture of tool bits 102 and 802 being installed in to the motor grader 1002, it is envisioned that a motor grader 1002 may realize only one of the tool bit securing systems throughout the entirety of the bore hole 516 in the adapter board 506.

What is claimed is:

1. A tool bit comprising:

a threaded portion centered about and extending longitudinally along a first axis, the threaded portion including an anti-rotation receiving hole therethrough oriented to extend along a second axis transverse to the first axis;

a shank centered about and extending longitudinally along the first axis, the shank disposed between the threaded portion and a shoulder;

the shoulder extending radially outward from the shank;

an anti-rotation segment disposed between the shoulder and a working portion of the tool bit, the anti-rotation segment including a first surface and a second surface disposed opposite to the first surface, the anti-rotation segment configured to be received in an anti-rotation slot of an adapter board when the tool bit is mounted on the adapter board; and the working portion oriented to extend lengthwise away from the first axis and to extend lengthwise along a third axis, the third axis transverse to the first axis, the working portion including a planar cutting surface that includes a working edge, the planar cutting surface oriented transverse to the first axis.

2. The tool bit of claim 1, wherein the shank extends radially outward from the threaded portion.

3. The tool bit of claim 1, wherein the first surface is configured to abut against a first side of the anti-rotation slot of the adapter board.

4. The tool bit of claim 1, wherein the working edge is oriented parallel to the second axis.

5. The tool bit of claim 1, wherein the first surface of the anti-rotation segment is parallel to the second surface.

6. The tool bit of claim 1, wherein the first surface of the anti-rotation segment is flat.

7. The tool bit of claim 1 further comprising a castle nut configured to be disposed in a clearance region between a mold board of a machine and the adapter board mounted on the mold board, the castle nut configured to abut the shoulder against the adapter board when the castle nut is in threaded engagement with the threaded portion and secured to the adapter board, the castle nut including a first slot configured to receive a first portion of a pin when a second portion of the pin is disposed within the anti-rotation receiving hole.

8. The tool bit of claim 7, wherein the pin is a cotter pin or a lock wire.

9. The tool bit of claim 7, wherein the castle nut is configured to be disposed below the mold board in the clearance region.

10. The tool bit of claim 1, in which the anti-rotation segment further includes a rounded surface disposed between the first surface and the second surface.

11. The tool bit of claim 10, wherein an end of the rounded surface is configured to abut against the adapter board.

12. A tool bit comprising:

an internally threaded portion centered about and extending longitudinally along a first axis, the internally threaded portion configured to receive a retention bolt oriented parallel to the first axis;

a shank centered about and extending longitudinally along the first axis, at least part of the shank disposed between the threaded portion and a shoulder;

the shoulder extending radially outward from the shank;

an anti-rotation segment disposed between the shoulder and a working portion of the tool bit, the anti-rotation segment including a first surface and a second surface disposed opposite to the first surface, the anti-rotation segment configured to be received in an anti-rotation slot of an adapter board when the tool bit is mounted on the adapter board; and the working portion oriented to extend lengthwise away from the first axis and to extend lengthwise along a second axis, the second axis transverse to the first axis, the working portion including a planar cutting surface that includes a working edge, the planar cutting surface oriented transverse to the first axis.

13. The tool bit of claim 12, wherein the first surface is configured to abut against a first side of the anti-rotation slot of the adapter board.

14. The tool bit of claim 13, wherein the second surface is configured to abut against a second side of the anti-rotation slot of the adapter board.

15. The tool bit of claim 12, wherein the first surface of the anti-rotation segment is flat.

16. The tool bit of claim 12, in which the anti-rotation segment further includes a rounded surface disposed between the first surface and the second surface.

17. The tool bit of claim 16, wherein an end of the rounded surface is configured to abut against the adapter board.

18. A system for securing a plurality of tool bits to a machine that includes a mold board, the system comprising:

an adapter board that includes:

a plurality of bores extending therethrough;

a front surface;

a plurality of anti-rotation slots; and a back surface configured to define a clearance region with a bottom edge of the mold board when the back surface is mounted to the mold board, the clearance region adjacent to the plurality of bores; and the plurality of tool bits disposed in the plurality of bores in a one-to-one correspondence, each tool bit including:

a threaded portion centered about and extending longitudinally along a first axis, the threaded portion including an anti-rotation receiving hole therethrough oriented to extend along a second axis transverse to the first axis;

a shank centered about and extending longitudinally along the first axis, the shank disposed between the threaded portion and a shoulder;

the shoulder extending radially outward from the shank;

an anti-rotation segment disposed between the shoulder and a working portion, the anti-rotation segment including a first surface and a second surface disposed opposite to the first surface, the first surface and the second surface disposed in one of the plurality of anti-rotation slots of the adapter board;

the working portion oriented to extend lengthwise away from the first axis and to extend lengthwise along a third axis, the third axis transverse to the first axis, the working portion including a planar cutting surface that includes a working edge, the planar cutting surface oriented transverse to the first axis, the working edge oriented parallel to the second axis; and a castle nut configured to be in threaded engagement with the threaded portion of the tool bit, the castle nut including a plurality of slots, a first slot configured to receive a first portion of a pin when a second portion of the pin is disposed within the anti-rotation receiving hole.

19. The system of claim 18, wherein the pin is a cotter pin or a lock wire.

20. The system of claim 18, wherein the castle nut is adjacent to the back surface of the adapter board and is disposed in the clearance region when the adapter board is mounted to the mold board.

* * * * *